US005507425A

United States Patent [19]

Ziglioli

[11] Patent Number: 5,507,425

[45] Date of Patent: Apr. 16, 1996

[54] STAPLING MACHINE

[75] Inventor: Andrea Ziglioli, Turin, Italy

[73] Assignee: Acco-Rexel Group Services plc, West Drayton, England

[21] Appl. No.: 50,295

[22] PCT Filed: Nov. 19, 1991

[86] PCT No.: PCT/GB91/02045

§ 371 Date: Oct. 4, 1993

§ 102(e) Date: Oct. 4, 1993

[87] PCT Pub. No.: WO92/08579

PCT Pub. Date: May 29, 1992

[30] Foreign Application Priority Data

Nov. 19, 1990 [GB] United Kingdom ..... 9025131

[51] Int. Cl.[6] ..... B25C 5/16

[52] U.S. Cl. ..... 227/120; 227/127; 227/156; 116/278

[58] Field of Search ..... 227/19, 120, 127, 227/128, 139, 156; 173/20, 21; 206/459.1; 116/278, 284, DIG. 14; 235/107, 125

[56] References Cited

U.S. PATENT DOCUMENTS

| | | | |
|---|---|---|---|
| 2,982,966 | 5/1961 | La Pointe et al. | 227/120 X |
| 4,506,819 | 3/1985 | Rand | 227/120 |
| 4,523,750 | 6/1985 | Hubler | 227/120 X |
| 4,591,086 | 5/1986 | Campbell et al. | 227/19 |
| 4,978,045 | 12/1990 | Murakami et al. | 227/120 X |

FOREIGN PATENT DOCUMENTS

| | | |
|---|---|---|
| 811464 | 8/1951 | Germany . |

*Primary Examiner*—Scott A. Smith
*Assistant Examiner*—Jay A. Stelacone
*Attorney, Agent, or Firm*—Popham, Haik, Schnobrich & Kaufman, Ltd.

[57] ABSTRACT

A stapling machine is provided which has markings on part of a constant tension spring visible from the exterior of the machine to provide an indication when the supply of staples within the machine is exhausted. The constant tension spring moves the pusher, and markings are present on part of the constant tension spring which becomes visible in a window provided for that purpose.

2 Claims, 2 Drawing Sheets

STAPLING MACHINE

The present invention relates to a stapling machine and more particularly relates to a stapling machine intended to staple together a plurality of pieces of paper.

According to one aspect of this invention there is provided a stapling machine comprising a staple pusher to push staples within a magazine and a spring to bias the staple pusher, there being a marking provided on the spring, which marking is visible from the exterior of the machine to provide an indication when the supply of staples within the machine is becoming exhausted.

Preferably the spring is a substantially constant tension spring formed of a spring strip wound partly into a spiral, means being provided to retain the spiral portion in a substantially predetermined position, said marking being on the part of the spring that forms the exterior of the spiral portion as the supply of staples within the machine becomes exhausted.

Figure 1:
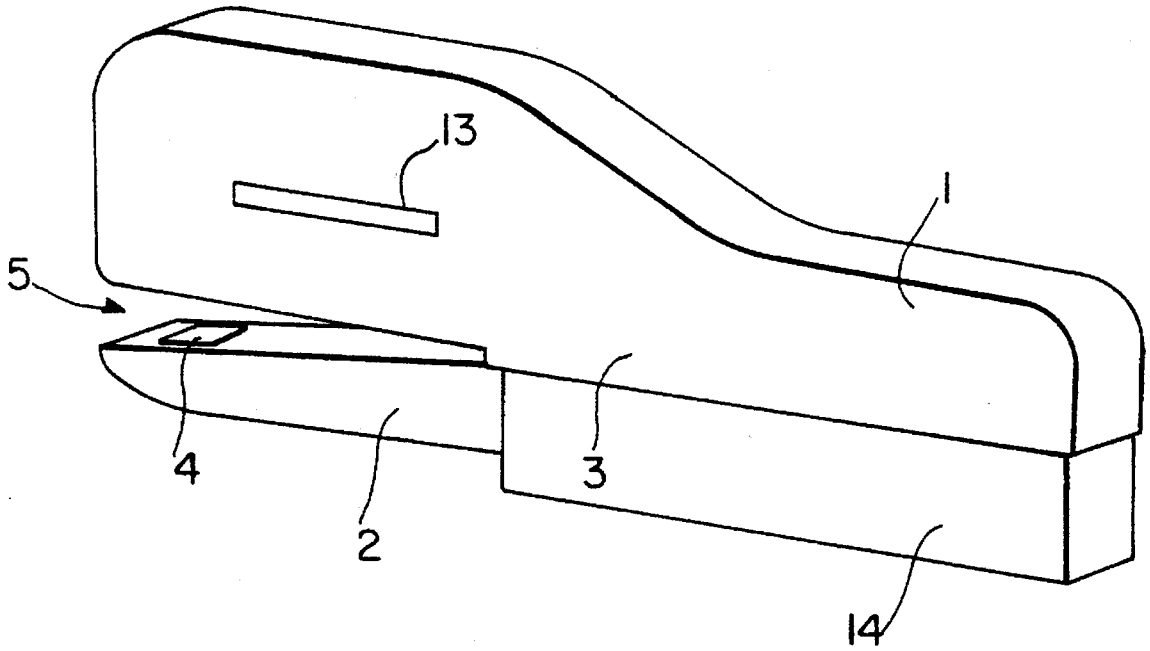
Figure 2:
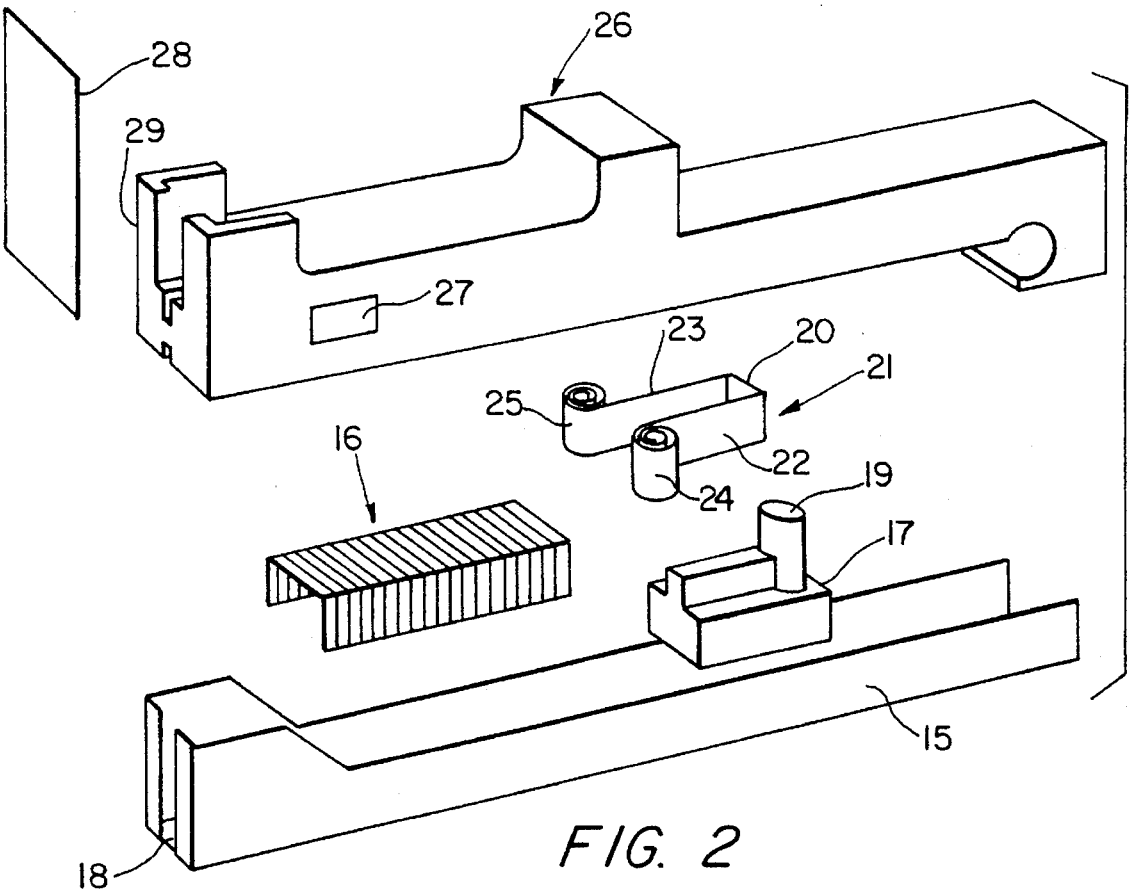
Figure 3:
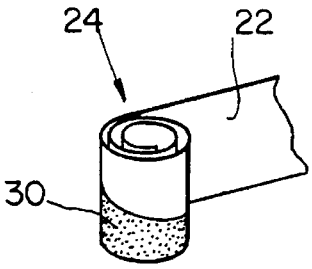
Figure 4:
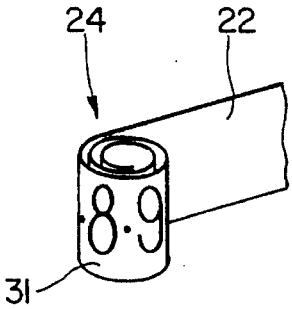

In order that the invention may be more readily understood, and further features thereof may be appreciated, the invention will now be described, by way of example, with reference to the accompanying drawings in which FIG. 1 is a perspective view of a stapling machine in accordance with the invention, FIG. 2 is a view of some of the operative components of the stapling machine of FIG. 1, FIG. 3 is an enlarged view of part of the constant tension spring of FIG. 2, and FIG. 4 is an enlarged view, corresponding to FIG. 3 showing an alternative embodiment.

The stapling machine of FIG. 1 comprises an upper housing 1, which contains a magazine for staples and which contains a mechanism, to be described in more detail hereinafter, to eject a staple, from the staple magazine, through an ejection slot. The front part of the housing 1, shown towards the left in FIG. 1, carries beneath it an arm 2, which is pivotally mounted about a notional pivot point 3, the arm 2 carrying on its upper surface an anvil 4 adapted to deflect the ends of a staple ejected from the ejection slot when the staple has passed through a plurality of sheets of paper to be stapled together.

A gap 5 is defined between the lower part of the housing 1 and the upper part of the arm 2 so that sheets of paper to be stapled together may be inserted in position in the gap, and may then be stapled together.

The housing 1 contains a mechanism comprising a magazine 15 in the form of an open top channel dimensioned to receive a strip of staples 16. A staple pusher 17 is provided adapted to be inserted in the channel and slide along the channel thus biassing the staples 16 towards an ejection slot 18 defined by the front end of the magazine 15.

The staple pusher 17 has an upstanding edge 19 which is adapted to be engaged by a cross piece 20 forming part of a constant tension spring 21. The cross piece 20 interconnects two spring strip portions 22,23 which each terminate with a respective spiral portion 24,25. A staple steady 26 is provided adapted to lie over the staples, the staple steady defining, in its under-surface, recesses adapted to receive the spiral portions 24,25. A window 27 provides visual access to this recess.

An ejector blade 28 is provided adapted to move past the front end 29 of the staple steady and to drive a staple through the ejection slot 18.

The staple ejector blade is moved downwardly so that the blade encounters a staple which is provided at the end of a strip of staples. The end staple is engaged with part of the ejection slot.

The stapling machine of FIG. 1 is actuated by means of an actuator element 14 or trigger which is located beneath the rear part of the housing 1, that is to say the part of the housing 1 located towards the right-hand side as illustrated in FIG. 1. It is envisaged that the stapling machine of FIG. 1 will be operated in the manner of a pair of pliers and will be grasped in one hand, with the palm of the hand resting on the upper surface of the rear part of the housing 1 as shown to the right-hand side of FIG. 1, and with the fingers curled beneath of the actuator element 14. By applying upward pressure to the actuator element 14, by tightening the grip of the fingers, the arm 2 will initially pivot upwards slightly so that paper inserted into the gap 5 is gripped, and subsequently the ejector 28 will be moved downwardly to eject the staple through the ejection slot, the two arms of the staple passing through the paper and then being clinched together by the anvil 4.

The housing 1 is provided with a slot 13, although the slot 13 may have a transparent infill.

It is to be appreciated that as the staples 16 become exhausted the spring strips 22,23 are drawn into the spiral portions 24,25, thus moving the staple pusher 17 along the magazine 15 and biassing the staples 16 towards the ejection slot.

As the supply of staples becomes exhausted a part of the strip 22, as shown in FIG. 3, forms the exterior of the spiral portion 24. This part of the strip 22 carries a marking 30. The marking may be of a red colour and may have an inclined upper edge. Thus, initially, an unmarked part of the spring is visible through the window 27, but as the supply of staples becomes exhausted the marking 30 becomes visible in the window 27. As the supply of staples becomes totally exhausted the marking totally fills the window 27.

In an alternative embodiment of the invention, as illustrated in FIG. 4, a marking 31 is provided comprising a series of numerals. These numerals are displayed through the window 27 as the supply of staples becomes exhausted, to give a numerical indication of the number of staples remaining.

Whilst the invention has been described with reference to a "pliers" type machine with reference to FIGS. 1 and 2 it is to be understood that the invention is equally applicable to a conventional desk-top machine.

I claim:

1. A stapling machine having an interior and an exterior, the stapling machine comprising a magazine for holding a supply of staples, a staple pusher to push staples within the magazine, and a spring to bias the staple pusher, the spring having a surface, the surface being provided with a marking to provide an indication when the supply of staples within the machine is becoming exhausted, the marking being visible from the exterior of the stapling machine.

2. A stapling machine according to claim 1 wherein the spring is a substantially constant tension spring formed of a spring strip having an end portion wound into a spiral portion, the spiral portion having an exterior, and the spring strip having a surface that forms the exterior of the spiral portion as the supply of staples within the machine becomes exhausted, and wherein the machine further comprises means to retain the spiral portion in a substantially predetermined position, said marking being on the surface of the spring strip that forms the exterior of the spiral portion as the supply of staples within the machine becomes exhausted.

* * * * *